US005388980A

United States Patent [19]

Kijima et al.

[11] Patent Number: 5,388,980

[45] Date of Patent: Feb. 14, 1995

[54] SPINNING NOZZLE TIP STRUCTURE

[75] Inventors: Kouichi Kijima; Sotomi Ishizaka; Shinobu Uenomachi, all of Sendai; Michiharu Kodama, Nobeoka, all of Japan

[73] Assignees: Kyocera Corporation, Kyoto; Asahi Kasei Kogyo Kabushiki Kaisha, Osaka, both of Japan

[21] Appl. No.: 781,854

[22] Filed: Oct. 24, 1991

[30] Foreign Application Priority Data

Feb. 27, 1991 [JP] Japan ..... 3-057835

[51] Int. Cl.[6] ..... B29C 47/12

[52] U.S. Cl. ..... 425/461; 425/192 S; 425/382.2; 425/463; 425/464

[58] Field of Search ..... 425/192 S, 464, 463, 425/461, 72.2, 466, 467, 382.2; 277/189; 266/271

[56] References Cited

U.S. PATENT DOCUMENTS

| | | | |
|---|---|---|---|
| 1,788,660 | 1/1931 | Colomb | 425/461 |
| 2,879,676 | 3/1959 | Burkhardt et al. | 425/461 |
| 3,006,026 | 10/1961 | Martin et al. | 425/464 |
| 3,049,753 | 8/1962 | Ogden et al. | 425/464 |
| 3,174,183 | 3/1965 | Siegel | 425/461 |
| 3,299,470 | 1/1967 | Stockbridge | 425/192 S |
| 3,437,725 | 4/1969 | Pierce | 425/192 S |
| 3,453,689 | 7/1969 | Hume | 425/192 S |
| 3,516,120 | 6/1970 | Braun et al. | 425/382.2 |
| 3,540,080 | 11/1970 | Goossens | 425/192 S |
| 3,724,064 | 4/1973 | Mott | 425/464 |
| 3,854,735 | 12/1974 | Maurer et al. | 277/189 |
| 3,913,421 | 10/1975 | Hawkins | 425/464 |
| 4,248,577 | 2/1981 | Bory et al. | 425/463 |
| 4,544,341 | 10/1985 | Gnadig et al. | 425/461 |
| 4,946,083 | 8/1990 | Fishler et al. | 266/271 |

FOREIGN PATENT DOCUMENTS

| | | | |
|---|---|---|---|
| 0154370 | 3/1982 | Germany | 425/192 S |
| 236119A1 | 5/1986 | Germany | 425/192 S |
| 605594 | of 1960 | Italy | 425/464 |
| 58-76512 | of 1983 | Japan . | |

OTHER PUBLICATIONS

U.S. Patent Office, Defensive Publication No. T857,042, Dec. 1968.

Handbook of Chemistry and Physics, 31st ed., Chemical Rubber Publishing Co., Cleveland, Ohio, 1949, (pp. 1772–1775), edited by Charles Hodgman.

*Primary Examiner*—Jay H. Woo
*Assistant Examiner*—Joseph Leyson
*Attorney, Agent, or Firm*—Spensley Horn Jubas & Lubitz

[57] ABSTRACT

A spinning nozzle tip structure arranged such that a nozzle piece made of any one of ceramics, cermets or cemented carbides and having a spinning nozzle is fitted into an accommodating hole formed in a nozzle body made of a metal such as stainless steel, said spinning nozzle tip structure being characterized in that a metal ring is interposed between the nozzle piece and the nozzle body so as to effect liquid-hermetic sealing therebetween.

13 Claims, 3 Drawing Sheets

SPINNING NOZZLE TIP STRUCTURE

BACKGROUND OF THE INVENTION

1. Field of the Invention

The present invention relates to improvement of a spinning nozzle tip structure for spinning fibres of a given sectional shape and thickness with a polymer dope as material.

2. Prior Arts

The spinning nozzle tip structure used for spinning of synthetic fibres comprises, as shown in FIG. 8, a disc-shaped nozzle body 10 having therein a plurality of inlet holes 11 and a plurality of spinning nozzles 12 communicating therewith. The fibres are pulled out of the polymer dope through the spinning nozzles 12 of the aforementioned spinning nozzle tip structure and, if necessary, are further stretched to thereby obtain synthetic fibers of the desired sectional shape and thickness. The nozzle body 10 may be made of any one of the following materials: any metal such as stainless steel; ceramics; cermets; carbide alloy; etc. A spinning nozzle tip made of a metal such as stainless steel has the following drawbacks: It is subject to deposition of carbides of the polymer dope; of cleaning of the spinning nozzle tip structure becoming inevitable after a relatively short period of use; and of the life of the spinning nozzle tip structure is short due to the low abrasion resistance thereof. A spinning nozzle tip structure made of a hard material such as a ceramic, cermet, or cemented carbide has the drawback that it is difficult to precisely form a plurality of nozzles 12 therein, this resulting in an extremely low manufacturing yield of spinning nozzle tip structures and high manufacturing cost.

In order to eliminate these difficulties a new type of spinning nozzle tip structure was already proposed, in which a spinning nozzle piece with inlet holes and spinning nozzles formed therein and made of a ceramic,-cermet or cemented carbide is fitted into a mating hole, that is a nozzle accommodating hole, formed in the nozzle body made of a metal, instead of providing the inlet holes 11 and spinning nozzles 12 in the disc-shaped nozzle body 10 for achieving leakless jointing between nozzle body and spinning nozzle piece (Japanese Laid-open Patent Publication No. 58-76512). In this attempt, however, coupling of the spinning nozzle piece with the nozzle body was difficult. Coupling by shrink fitting, press fitting, mechanical connection or the like alone, however, could not seal the joint liquid-hermetically, this resulting in leakage of the polymer dope. If the joint is brazed for making it hermetic, the spinning nozzle piece is subjected to a greater stress during cooling after brazing because of the larger thermal expansion coefficient of the nozzle body, this giving rise to cracking of the spinning nozzle piece.

SUMMARY OF THE INVENTION

The present invention has been made for elimination of the aforementioned difficulties presented by known spinning nozzle tip structures of the type in which a spinning nozzle piece is fitted into an accommodating hole formed in the nozzle body, and is intended for having the spinning nozzle piece sealed against the nozzle body hermetically to ensure against leakage of the high-temperature polymer dope under a high pressure without the risk of crack formation in the spinning nozzle piece.

Another object of the invention is to provide a spinning nozzle tip structure which can be manufactured at a low cost with a high yield, being safer from deposition of carbides of polymer dope and also abrasion.

In order to accomplish these objects the spinning nozzle tip structure of the present invention is so arranged that the spinning nozzle piece made of a ceramic, cermet, cemented carbide or the like is fitted into the accommodating hole formed in the nozzle body made of a metal, with a preformed metal ring interposed between the spinning nozzle piece and the nozzle body for sealing the joint in one end portion liquid-hermetically.

BRIEF DESCRIPTION OF THE DRAWINGS

In the figures like reference numerals represent like parts.

DETAILED DESCRIPTION OF THE INVENTION

Figure 1:
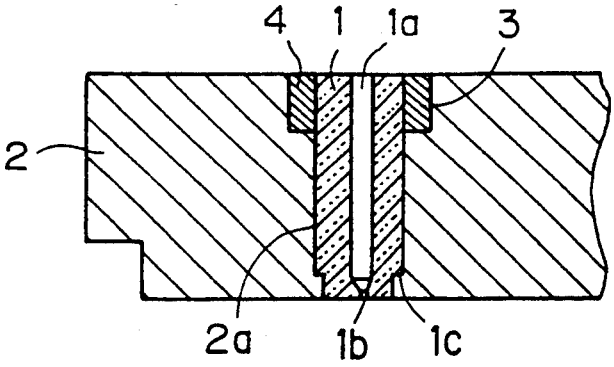
FIGS. 1–7 are cross-sectional detail views showing various embodiments of spinning nozzle tip structures according to the present invention.

In the spinning nozzle tip of the present invention, a nozzle body made of a metal such as stainless steel has an accommodating hole formed therein and in this hole a spinning nozzle piece made of a ceramic, cermet, cemented carbide or the-like having formed therein an inlet hole and a spinning nozzle is fitted and a metal ring is interposed between the nozzle body and the spinning nozzle piece for hermetic sealing of the joint therebetween in one end portion thereof.

In a preferred example of the present invention, hermetic sealing of the joint between the nozzle body and the spinning nozzle piece is accomplished by providing a groove in one end portion of and concentric with the accommodating hole and setting the metal ring therein.

Liquid-hermetic sealing of the joint between the nozzle body and the spinning nozzle piece can be accomplished by press-fitting a metal ring whose inside diameter is slightly smaller than the outside diameter of the spinning nozzle piece and whose outside diameter is slightly larger than the inside diameter of the groove into the (square-sectioned) groove. It is also possible to have a metal ring whose outside diameter is slightly larger than the inside diameter of the groove pre-brazed to the outer periphery of the spinning nozzle piece and to then press-fitting the pre-brazed nozzle-and-ring into the space defined by the accommodating hole and the groove concentric therewith.

Still another alternative method is to have the inner as well as outer peripheries of the metal ring brazed to the spinning nozzle piece and the groove's inner periphery for liquid hermetic sealing. For that, however, it is essential that the metal ring be made of a metal whose thermal expansion coefficient is smaller than that of the nozzle body so as to modify the stress acting in the spinning nozzle piece during cooling after brazing. In another preferred example of the present invention a soft metal ring is pressed into the groove provided at one end of the accommodating hole formed in the nozzle body and the hard metal ring is fitted into the groove to cover the soft metal ring's surface. As used herein, a "soft metal ring" is a ring made of a metal whose Brinnel hardness is not more than 150 kg/mm$^2$. Since in this invention the spinning nozzle piece is made of a ceramic, cermet or cemented carbide a spinning nozzle tip structure of long service life without risk of deposition of carbides of polymer dope or early abrasion is obtainable without fail. The ceramics which may preferably be used include alumina, zirconia, silicium carbide, silicium nitride, etc. The cermets which may be used include containing not less than 50 weight % of carbides, nitrides or carbonitrides of transition metals of Groups 4*a* and 5*a* of the Periodic Table such as TiC, TiN, TiCN, NbC and TaC and also containing metals of the iron family (Fe, Ni, Co). The cemented carbides which may preferably be used include hard sintered alloys with tungsten carbide as the chief ingredient and also containing cobalt.

As materials of the nozzle body 1 there may be used, among others, stainless steel, Kovar TM which is an Fe—Ni—Co alloy, 42Ni alloy and Incoloy TM, which is a corrosion-resistant alloy of Ni, Fe and Cr.

As materials for the metal ring use may be made of various metals such as stainless steel, Kovar TM, 42Ni alloy, Incoloy TM, steel and aluminium.

EXAMPLES

Embodiments of the present invention will be described below with reference to the annexed drawings.

The spinning nozzle tip structure shown in FIG. 1 is so arranged that a spinning nozzle piece 1 made of a ceramics, cermet or cemented carbide is fitted into a nozzle piece accommodating hole, that is, an accommodating hole 2*a* formed in a nozzle body 2, and a metal ring 4 is interposed therebetween as a sealing means. This spinning nozzle piece 1 has formed therein an inlet hole 1*a* for pulling out the fibre and a spinning nozzle 1*b* and a step 1*c* for preventing the spinning nozzle piece 1 from sliding out of the nozzle body 2 when a high pressure is applied to the polymer dope. On the side opposite to the spinning nozzle side of the accommodating hole formed in the nozzle body there is formed a groove 3 concentric with the accommodating hole 2*a*, and the metal ring 4 is pressed into this groove. The metal ring 4 pressed into the groove 3 comes into close contact with the spinning nozzle piece 1 and the nozzle body 2 for liquid-hermetic sealing thereof. Hence, the spinning nozzle tip structure shown in FIG. 1 is excellent in sealing performance, also being extremely easy to manufacture.

Figure 2:
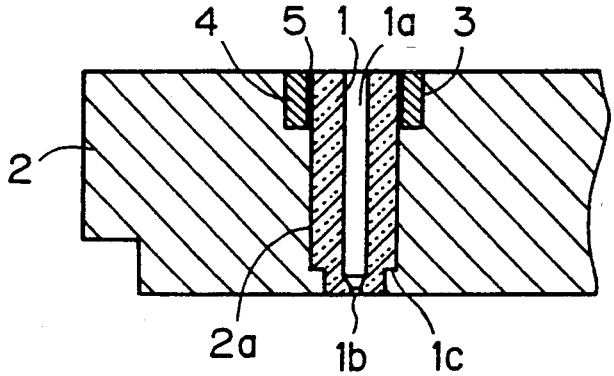

The spinning nozzle tip structure shown in FIG. 2, is like that shown in FIG. 1 in that the spinning nozzle piece 1 is made of a ceramic, cermet or cemented carbide and is fitted into the accommodating hole 2*a* formed in the nozzle body 2 made of metal and the metal ring 4 is interposed therebetween. This metal ring 4 is fitted into the groove 3 formed in the nozzle body 2 and the metal ring 4 is brazed to the spinning nozzle piece 1 by means of a solder layer 5. For this mode of bonding the metal ring 4 is pre-brazed to the nozzle piece 1 and, with the spinning nozzle piece 1 being fitted into the accommodating hole 2*a*, the metal ring 4 is pressed into the groove 3. Alternatively, it is also possible to have the metal ring 4 pressed into the groove 3, then the nozzle piece 1 is fitted into the accommodating hole, this followed by brazing thereof to the metal ring 4. In this case, too, the metal ring 4 is securely bonded to the nozzle body 2, hence the sealing performance is excellent.

In the spinning nozzle tip structure shown in FIG. 1 or FIG. 2, when the metal ring 4 is made of a relatively soft metal such as copper or aluminum, it is deformed plastically as it is pressed into the groove, this resulting in an improved sealing between the spinning nozzle piece 1 and the nozzle body 2. Even when the metal ring 4 is made of a relatively hard metal such as stainless steel, the sealing performance can be improved sufficiently by properly adjusting the press-fitting allowance, that is, the difference between the outside diameter of the metal ring 4 and the inside diameter of the groove 3 (the former being slightly larger) and the difference between the inside diameter of the metal ring 4 and the outside diameter of the spinning nozzle piece 1 (the latter being slightly larger), this being effective for improving the anti-abrasive resistance of the exposed surface of the metal ring 4.

Figure 3:
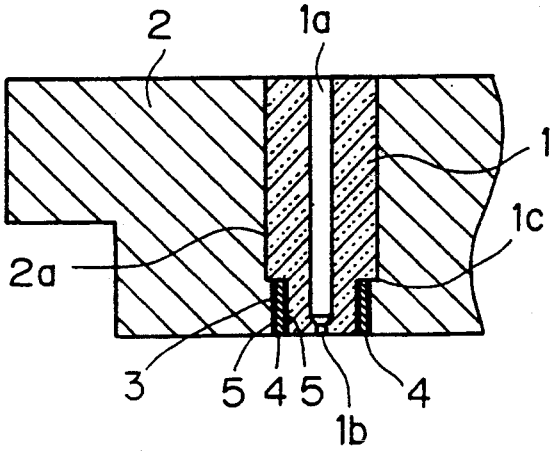

In the spinning tip shown in FIG. 3, a smaller diameter groove 3 in diameter concentric with and surrounding the accommodating hole 2*a* in the nozzle body 2 is provided on the spinning nozzle side of the hole 2*a* and the metal ring 4 set in the groove 3 is brazed to both spinning nozzle piece 1 and nozzle body 2 by means of solder. Normally in this arrangement the nozzle body 2 made of a material such as stainless steel has a greater thermal expansion coefficient than the spinning nozzle piece 1 made of a ceramic, cermet, cemented carbide or the like, hence the spinning nozzle piece is subjected to stress during cooling after brazing. In order to modify this stress the metal ring 4 is made of a metal having a lower in thermal expansion coefficient than the material of the nozzle body. More generally, the material of ring 4 may be a metal with its thermal expansion coefficient equal to that of the spinning nozzle piece 1 or between that of the spinning nozzle piece 1 and that of the nozzle body 2. When, for instance, the nozzle body 2 is made of stainless steel, the metal ring 4 may be made of Kovar TM, 42Ni alloy, Incoloy TM, Invar TM or the like.

Figure 4:
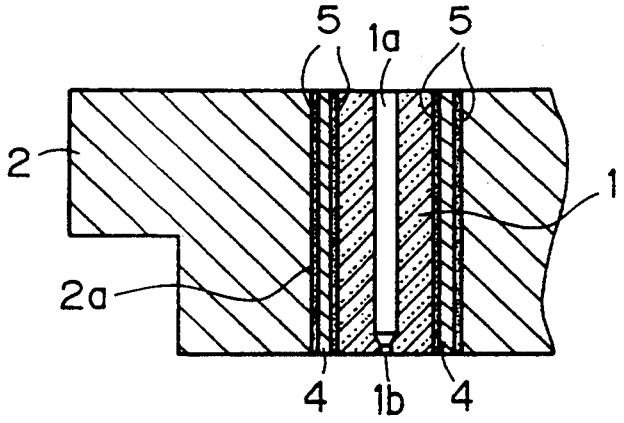

When the metal ring 4 is to be brazed to both spinning nozzle piece 1 and nozzle body 2, the step 1*c* of the spinning nozzle piece 1 may be dispensed with as shown in FIG. 4 and, instead, the metal ring 4 may be disposed along the entire length and periphery of the spinning nozzle piece 1 and may be brazed thereto.

Figure 5:
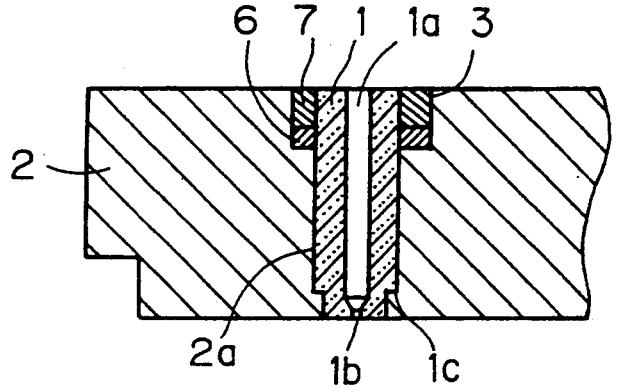

In the spinning nozzle tip structure shown in FIG. 5 the spinning nozzle piece 1 made of a ceramic, cermet or cemented carbide is disposed inside the accommodating hole 2*a* formed in the nozzle body 2 and is bonded to the nozzle body 2 via two metal rings 6 and 7. The spinning nozzle piece 1 comprises the inlet hole 1*a*, spinning nozzle 1*b* and the step 1*c* to ensure against sliding out thereof. On the inlet side of the accommodating hole 2*a* formed in the nozzle body 2 is formed the groove 3 concentric with the accommodating hole 2*a*. From the bottom side the soft metal ring 6 less than 150 $kg/mm^2$ in Brinnel hardness is pressed into this groove and this pressed-in soft metal ring 6 is covered with a hard metal presser ring 7 more than (inclusive) 150 $kg/mm^2$ in Brinnel hardness. Since in this spinning nozzle tip structure the soft metal ring 6 is pressed in, the soft metal ring 6 plastically deforms to come into close contact with both spinning nozzle piece 1 and nozzle body 2 for perfect sealing of the joints. By press-fitting the presser ring 7 of a hard metal to cover the soft metal ring 6, falling off of the soft metal ring 6 can be prevented with simultaneous improvement of the surface abrasion resistance as well as corrosion resistance. Another merit of this kind of spinning nozzle tip structure is that the manufacturing method is very easy without the necessity of brazing.

Figure 6:
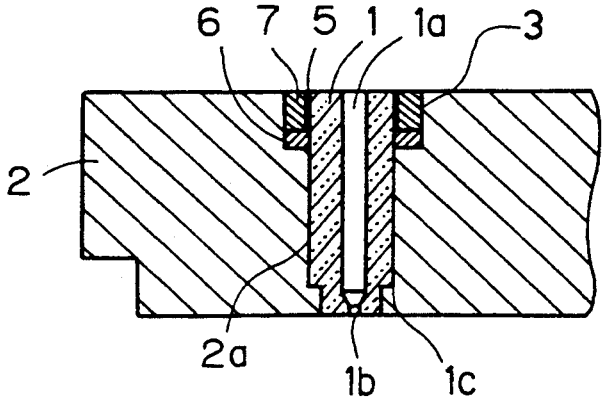

The spinning nozzle tip structure shown in FIG. 6 is of the same structure as that shown in FIG. 5 except that the presser ring 7 is brazed to the spinning nozzle piece 1 by the use of the solder 5 and is pressed into the groove 3 formed in the nozzle body 2. In order to accomplish this bonded structure, the soft metal ring 6 may first be pressed into the groove 3 and then the spinning nozzle piece 1 with the presser ring 7 brazed thereto may be fitted into the accommodating hole 2*a* with simultaneous press-fitting of the presser ring 7 into the groove 3 as the topmost layer. In this step a soft metal ring 6, too, is pressed to plastically deform. In an alternative method, the spinning nozzle piece 1 may first be fitted into the accommodating hole formed in the nozzle body, then the soft metal ring 6 and the presser ring 7 are pressed in and finally the presser ring 7 may be brazed to the spinning nozzle piece 1. In this case, too, the soft metal ring 6 is deformed plastically to be in close contact with both spinning nozzle piece 1 and nozzle body 2, hence the joints can be sealed excellently.

Although illustration is here omitted, it is also possible to constitute the spinning nozzle tip structure by brazing the presser ring 7 to both spinning nozzle piece 1 and nozzle body 2. In this case the stress to which the brazed assembly is subjected to as it is cooled after brazing can be modified and there is no risk of cracks being formed in the spinning nozzle piece 1.

Figure 7:
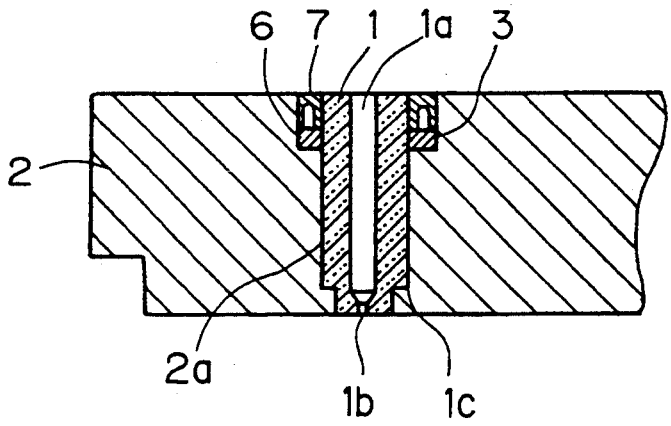
Figure 8:
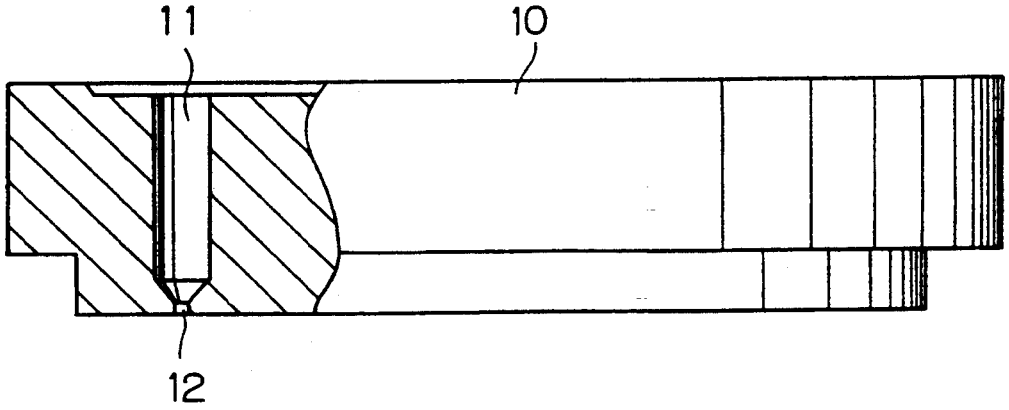
FIG. 8 (Prior Art)
FIG. 8 shows a cross-sectional view of a conventional nozzle tip structure.

The spinning nozzle tip structure shown in FIG. 7 is, like the nozzle tip structures described above, made by fitting the spinning nozzle piece 1 made of a ceramic, cermet or cemented carbide into the accommodating hole formed in the metallic nozzle body 2, then press-fitting the soft metal ring 6 into the groove 3 and finally press-fitting the presser ring 7 to cover the soft metal ring 6 so as to secure the spinning nozzle piece 1 to the nozzle body 2.

The aforementioned presser ring 7 is inverted U-shaped in cross-section and has elasticity in the radial direction. Hence, in this spinning nozzle tip structure the stress flow from the nozzle body 2 to the spinning nozzle piece 1 caused by the temperature variation is absorbed, and cracking in the spinning nozzle piece 1 during manufacture as well as during use can be prevented. The presser ring 7 may be made of a springy material such as stainless steel or sulfur bronze. Alternatively, the presser ring 7 may be assembled by combination of press-fitting and brazing or brazing alone.

In the spinning nozzle tip structures shown in FIGS. 5–7, the soft metal ring 6 may be made of a soft metal with a Brinnel hardness of less than 150 kg/mm$^2$ such as copper, aluminum, zinc and brass. Such metals low in hardness are easily deformed plastically when pressed in or kept pressed and will come into close contact with the spinning nozzle piece 1 and nozzle body 2 for improved sealing.

Meanwhile, as material of the presser ring 7, as shown in Table 2, may be made of a hard metal higher in hardness than soft metal ring 6 such as stainless steel, 42Ni alloy, Kovar TM or the like not less than 150 kg/mm$^2$ in Brinnel hardness. Stainless steel, in particular, excels in corrosion resistance as well as abrasion resistance.

Thus, by using the soft metal ring 6 with its plastic deformability and also using the presser ring 7 to cover it it is possible to improve sealability, to prevent dropping off of the soft metal ring 6 and also improve surface abrasion resistance, these all contributing to manufacture of a spinning nozzle tip structure of improved performance.

TABLE 1

| Material | Brinnel hardness (kg/mm$^2$) |
|---|---|
| Copper | 50 |
| Aluminum | 15–26 |
| Zinc | 30–60 |
| Brass | 80–130 |

TABLE 2

| Material | Brinnel hardness (kg/mm$^2$) |
|---|---|
| Stainless steel (SUS630) | 363≦ |
| Stainless steel (SUS316) | 187≦ |
| Kovar TM | 210–240 |
| 42Ni alloy | 200–220 |

In the spinning nozzle tip structure of the present invention described above the stepping 1*c* of the nozzle piece 1 is not necessarily indispensable, and it is possible to make the spinning nozzle piece 1 straight and prevent slipping out of the spinning nozzle piece 1 by means of the metal ring 4 alone or the soft metal ring combination of the soft metal ring 6 and the presser ring 7.

In the drawing figures there is shown only one spinning nozzle piece 1 but actually a plurality of spinning nozzle pieces 1 are provided in each nozzle body 2.

Examples 1–3 and Contrast Examples 1–2

Example 1

A spinning nozzle tip structure of the structure shown in FIG. 1 was manufactured in the following way. The spinning nozzle piece was 6 mm in diameter and 20 mm long and had a step of 3 mm, and was made of a cermet comprising TiC and TiN as its chief ingredients. The nozzle body was of stainless steel (SUS630), was disc-shaped, 65 mm in diameter and 20 mm thick with 34 nozzle accommodating holes 6.1 mm in diameter and a groove 8 mm in inside diameter and 5 mm deep and concentric with the accommodating hole on the inlet side thereof.

First, the spinning nozzle piece was fitted into the accommodating hole formed in the nozzle body, and then a copper ring 1 mm thick was pressed into the groove cut in the nozzle body. This copper ring had its outside diameter made 0.02–0.05 mm larger than the inside diameter of the groove and its inside diameter made 0–0.04 mm smaller than the outside diameter of the spinning nozzle piece. The pressing load was 800 kg. The copper ring was found to be deformed plastically as it was pressed in to come into close contact with both spinning nozzle piece and nozzle body 2 for perfect sealing of the joints.

Example 2

Example 2 differs from Example 1 only in that a metal ring of Kovar TM was used instead of the copper ring in Example 1, that the outside diameter of the metal ring was 0–0.014 mm larger than the inside diameter of groove 3 and that the inside diameter of the metal ring was 0–0.04 mm smaller than the outside diameter of the spinning nozzle piece.

Example 3

A spinning nozzle tip structure of construction as shown in FIG. 2 was manufactured in the following way. The spinning nozzle piece and the nozzle body used were same in material and dimensions as used in the example 1. First, Ni-plating was applied to the part to be brazed, this was inserted in a 1 mm thick metal ring of 42Ni alloy 6.1 mm in inside diameter and it was then brazed at approx. 850° C. by the use of silver solder. Then the spinning nozzle piece was inserted into the accommodating hole with simultaneous press-fitting of the metal ring into the groove. The outside diameter of the metal ring prior to press-fitting was made 0.02–0.06 mm larger than the inside diameter of the groove,

Contrast Example

The spinning nozzle piece used was same in material and dimensions as in Example 1 and the nozzle body used was of the same material and dimensions as in Example 1 except that the groove 3 was not formed therein. In contrast Example 1 the spinning nozzle piece was fixed to the nozzle body simply by brazing and in contrast Example 2 the spinning nozzle piece was fixed to the nozzle body simply by a shrink fit.

For these Examples 1–3 and Contrast Examples 1 and 2, four each spinning nozzle tip structures having 34 spinning nozzle pieces therein were prepared, and the number of spinning nozzle pieces having had cracks in the course of manufacture of spinning nozzle tip structures was counted. Each four spinning nozzle tip structures were fixed to one unit of a spin box, melt spinning of polymer was performed at various pressures and the pressure when even one leak occurred during a hold time of 48 hours was checked as the withstanding pressure.

The result is as shown in Table 3. In Contrast Example 1, in which the spinning nozzle piece was directly brazed to the nozzle body, cracking took place in the course of cooling after brazing and leakage occurred due to crack formation, this interfering with the melt spinning test. In Contrast Example 2 sealing performance was poor because of coupling simply by shrinkage fit and the withstanding pressure at the time of melt spinning was as low as 100 kg/cm$^2$. Generally this withstanding pressure is required to be not less than 250 kg/cm$^2$, hence Contrast Example 2 is not good for practical use.

Meanwhile, the Examples 1–3 of the present invention show no indication of cracking in the course of manufacture, and the withstanding pressure at the time of melt spinning was not less than 300 kg/cm$^2$, this being quite excellent In Examples 1 and 2, which required no brazing, manufacturing method was quite easy.

Although in the above examples cermets were invariably used as ceramics, the results were substantially the same even when other ceramics or cemented carbides alloys were used.

TABLE 3

| | Metal ring mater. | Jointing method | No. of cracks 1 | 2 | 3 | 4 | Withstanding pressure (kg/cm$^2$) |
|---|---|---|---|---|---|---|---|
| Exam. 1 | Copper | Press-fitting ring | 0/34 | 0/34 | 0/34 | 0/34 | 300 |
| Exam. 2 | Kovar TM | Pressing fitting ring | 0/34 | 0/34 | 0/34 | 0/34 | 350 |
| Exam. 3 | 42Ni alloy | *) | 0/34 | 0/34 | 0/34 | 0/34 | 300 |
| Con. Exam. 1 | None | Brazing | 2/34 | 3/34 | 5/34 | 4/34 | **) |
| Con. Exam. 2 | None | Shrink fit | 0/34 | 0/34 | 0/34 | 0/34 | 100 |

*) Press-fitting ring pre-brazed to spinning nozzle piece.
**) Polymer dope leakage interfered with spinning test.

Examples 4, 5 and Contrast Example 3

Example 4

A spinning nozzle tip structure shown in Fig. 5 was manufactured in the following way.

The spinning nozzle piece and nozzle body used were of the same material and dimensions as in Example 1. First the spinning nozzle piece was fitted into the accommodating hole formed in the nozzle body and then a soft metal ring 8 mm in outside diameter, 6.1 mm in inside diameter and 1 mm thick was press-fitted into the groove. This soft metal ring was press-fitted with a load of 800 kg and was allowed to deform plastically. Then a presser ring made of 42Ni alloy was press-fitted but the outside diameter of the presser ring 7 was made 0.04–0.08 mm larger than the inside diameter of the groove formed in the nozzle body and 0–0.01 mm smaller than the outside diameter of the spinning nozzle piece 1. By this the soft metal ring is plastically deformed in the groove to come into close contact with both spinning nozzle piece and nozzle body for perfect sealing of the joints.

Example 5

A spinning nozzle tip structure having the form shown in FIG. 6 was made as follows.

Nozzle piece and nozzle body used were of the same materials and dimensions as in Example 4. First, Ni-plating was applied to the part to be brazed of the spinning nozzle piece 1, this spinning nozzle piece was fitted under a stainless-steel (SUS630) presser ring 1 mm thick and 6.1 mm in inside diameter and was brazed at approximately 850° C. Then, a 1 mm-thick soft metal ring of copper was inserted into a groove cut in the nozzle body and, thereafter, the aforementioned spinning nozzle piece with the presser ring 7 brazed thereto was inserted into the accommodating hole with simultaneous fitting of the presser ring into the groove. The pressing load was 800 kg, this being enough to effect plastic deformation of the soft metal ring. The outside diameter of the presser ring was made 0.02–0.06 mm larger than the inside diameter of the groove cut in the nozzle body.

Contrast Example 3

For Contrast Example 3 was taken the same spinning nozzle tip structure same as in Example 4 except that the soft metal ring 6 was replaced by a Kovar TM ring.

As to Examples 4, 5 and Contrast Example 3, four spinning nozzle tip structures were prepared each having 34 nozzles and the number of spinning nozzle pieces in which one or more cracks formed in the course of manufacture was checked. Each of the four spinning nozzle tip structures was connected to one unit of a spin box and melt spinning of polymer was carried out under various pressure conditions, which were maintained for 48 hours. The pressure at which even a single spot of wetting was discovered was taken as the withstanding pressure.

The result was as shown in Table 4. Contrast Example 3 in which a Kovar TM ring whose Brinnel hardness was greater than 150 kg/mm$^2$ was used instead of the soft metal ring was poor in sealing performance because of poor plastic deformability under pressure, and its withstanding pressure was only 200 kg/cm$^2$. Generally this withstanding pressure is required to be not less than 250 kg/cm$^2$, hence Contrast Example 3 is not suited for practical use.

In contrast thereto, Examples 4 and 5 of the present invention showed no indication of cracking in the process of manufacture, the withstanding pressure at the time of melt spinning being not less than 300 kg/cm$^2$. In Example 4 in which no brazing was done the method of manufacture was extremely easy.

In Examples 4 and 5 only cermet was used as material of spinning nozzle piece 1 but similar results were obtained even when other ceramics or cemented carbides were used.

TABLE 4

| | Soft metal ring material | Presser ring material | No. of cracks 1 | 2 | 3 | 4 | With standing pressure |
|---|---|---|---|---|---|---|---|
| Example 4 | Copper | 42Ni alloy | 0/34 | 0/34 | 0/34 | 0/34 | 350 |
| Example 5 | Copper | Stainless steel (SUS 630) | 0/34 | 0/34 | 0/34 | 0/34 | 350 |
| Con. Ex 3 | Kovar TM | 42Ni alloy | 0/34 | 0/34 | 0/34 | 0/34 | 200 |

Examples 6–9

Example 6

A spinning nozzle tip structure of the structure shown in FIG. 4 was manufactured in the following way. The spinning nozzle pieces were cylindrical ones of the same materials as used in Example 1, 6 mm in diameter and 20 mm long. The nozzle body used was of stainless steel (SUS630) and disclike 65 mm in diameter and 20 mm thick and 34 cylindrical accommodating holes 6.8 mm in inside diameter. The metal ring was a cylindrical Kovan TM ring 6.7 mm in outside diameter, 0.3 mm thick and 20 mm high. The spinning nozzle piece had its outer periphery Ni-plated, then was fitted into the accommodating hole formed in the nozzle body and was brazed thereto by the use of silver solder at approximately 850° C.

Examples 7–9

The spinning nozzle tip structure shown in FIG. 3 was manufactured in the following way. The dimensions of the spinning nozzle piece were the same as in Example 1. The material used in Example 7 was cermet as in Example 1, alumina ceramics in Example 8 and cemented carbide based on tungsten carbide also containing cobalt in Example 9. The material of the nozzle body used was stainless steel (SUS630) in Examples 7, 8 and 9 . The metal ring was of 42Ni alloy in Example 7 and of Incoloy TM in Examples 8 and 9. The thickness of the metal ring was made 0.35 mm, the gap between the metal ring and the spinning nozzle piece 0.05 mm and that between the metal ring and the nozzle body 0.025 mm. The part to be brazed of the spinning nozzle piece was Ni-plated, and the metal ring was then brazed to the nozzle piece and the nozzle body.

As to these Examples 6–9, four each nozzle bodies with 34 spinning nozzle pieces set therein were provided, the number of the spinning nozzle pieces which cracked was counted and the results are shown in Table 5 and the withstanding pressure during spinning was examined. Thanks to the buffering effect of the metal ring there was no crack formation in the spinning nozzle piece, and the withstanding pressure during spinning was not less than 300 kg/cm$^2$.

In Table 5 there are given in parentheses the thermal expansion coefficients (average of measurements taken at 30°–400° C.) for the spinning nozzle piece, nozzle body and metal ring in units of $10^{-6}$/° C. As to Examples 6 and 7, the thermal expansion coefficient of the used metal ring is lower than that of the spinning nozzle piece 1. Hence with such spinning nozzle tip structure the metal ring fastens the spinning nozzle piece to raise the bonding strength if the temperature should be raised to 200°–300° C. during spinning.

TABLE 5

| Examp. No. | Material of Nozzle piece | Nozzle body | Metal ring | No. of crack 1 | 2 | 3 | 4 | With standing pressure (kg/cm$^2$) |
|---|---|---|---|---|---|---|---|---|
| 6 | Cermet (7.8) | S. steel (11.7) | Kovar TM (4.8) | 0/34 | 0/34 | 0/34 | 0/34 | 350 |
| 7 | Cermet (7.8) | S. steel (11.7) | 42Nial (6.0) | 0/34 | 0/34 | 0/34 | 0/34 | 300 |
| 8 | Alumina (7.1) | S. steel (11.7) | Incol. TM (7.2) | 0/34 | 0/34 | 0/34 | 0/34 | 350 |
| 9 | Cem. car. | S. steel | Incol. TM | 0/34 | 0/34 | 0/34 | 0/34 | 300 |

TABLE 5-continued

| Examp. No. | Material of Nozzle piece | Nozzle body | Metal ring | No. of crack 1 | 2 | 3 | 4 | With standing pressure (kg/cm$^2$) |
|---|---|---|---|---|---|---|---|---|
| | al. (6.5) | (11.7) | (7.1) | | | | | |

We claim:

1. A spinning nozzle tip structure arranged such that a spinning nozzle piece made of any one of ceramics, cermets and cemented carbides is fitted into an accommodating hole formed in a nozzle body made of a metal, said nozzle tip structure further comprising a preformed metal ring that is interposed between the spinning nozzle piece and the nozzle body so as to seal the spinning nozzle piece liquid-hermetically.

2. A spinning nozzle tip structure arranged such that a spinning nozzle piece made of any one of ceramics, cermets and cemented carbides is fitted into an accommodating hole formed in a nozzle body made of a metal, said nozzle tip structure further comprising a preformed metal ring that is disposed in a groove cut at one end of the accommodating hole, and concentric with the accommodating hole, so as to seal the nozzle piece and the nozzle body liquid-hermetically.

3. A spinning nozzle tip structure according to claim 1 or 2, wherein the accommodating hole formed in the nozzle body has an inlet end and an outlet end and the accommodating hole is provided with a step making the hole smaller at the outlet end, the nozzle piece has an outlet end provided with a mating step making the nozzle piece smaller at the outlet end, and the step of the accommodating hole is engaged with the mating step of the nozzle piece.

4. A spinning nozzle tip structure according to claim 2, wherein said metal ring is press-fitted between the outer periphery of the spinning nozzle piece and the inner periphery of the groove cut in the nozzle body.

5. A spinning nozzle tip structure according to claim 2, wherein said metal ring is bonded with said spinning nozzle piece by brazing and is press-fitted into the groove for bonding with the nozzle body.

6. A spinning nozzle tip structure according to claim 1 or 2, wherein said metal ring is made of a material lower in thermal expansion coefficient than the material of the nozzle body, and said metal ring is brazed with both the spinning nozzle piece and the nozzle body.

7. A spinning nozzle tip structure according to claim 1, wherein said spinning nozzle piece has an outer circumferential surface, said accommodating hole in said nozzle body has an inner circumferential surface, and said metal ring is interposed between, and forms a seal with, said outer circumferential surface of said spinning nozzle piece and said inner circumferential surface of said accommodating hole in said nozzle body.

8. A spinning nozzle tip structure comprising: a nozzle body made of a metal and provided with a plurality of accommodating holes extending through said plate, each hole having two opposed ends, each hole being associated with a groove cut in said metal body, the groove surrounding, and being concentric with, the associated hole and being located at one end of the associated hole, and the groove having a side wall and a bottom; a plurality of spinning nozzle pieces each made of a ceramic, a cermet, or a cemented carbide, each said spinning nozzle piece being fitted into a respective accommodating hole; and sealing means including a metal sealing ring and a metal presser ring seated in each said groove to surround a respective spinning nozzle piece and to form a liquid-hermetic seal between the respective spinning nozzle piece and said nozzle body, said sealing ring being disposed at said groove bottom and being plastically deformed to sealingly engage the respective spinning nozzle piece and the associated groove side wall, and said presser ring being disposed to cover said sealing ring and being of a metal which is harder than the metal of said sealing ring.

9. A spinning nozzle tip structure according to claim 8, wherein each said spinning nozzle piece has an outer periphery and each said presser ring is fitted by pressing in between the outer periphery of a respective spinning nozzle piece and the side wall of a respective groove cut in the nozzle body.

10. A spinning nozzle tip structure according to claim 8, wherein said presser ring is brazed to the spinning nozzle piece.

11. A spinning nozzle tip structure according to claim 8, wherein said presser ring is brazed to both spinning nozzle piece and the nozzle body.

12. A spinning nozzle tip structure according to claim 8, wherein said presser ring is of a shape imparting resiliency to said presser ring in the diametrical direction.

13. A spinning nozzle tip structure according to claim 8 wherein said sealing ring is of a metal having a Brinnel hardness of less than 150 kg/mm$^2$ and said presser ring is of a metal having a Brinnel hardness greater than that of said sealing ring.

* * * * *